US011549699B2

(12) United States Patent
Ediger et al.

(10) Patent No.: US 11,549,699 B2
(45) Date of Patent: Jan. 10, 2023

(54) PORTABLE HUMIDIFIER

(71) Applicant: Vornado Air, LLC, Andover, KS (US)

(72) Inventors: Glen Wesley Ediger, North Newton, KS (US); Brian Cartwright, Wichita, KS (US); Gregory Pease, Andover, KS (US)

(73) Assignee: Vornado Air, LLC, Andover, KS (US)

( * ) Notice: Subject to any disclaimer, the term of this patent is extended or adjusted under 35 U.S.C. 154(b) by 0 days.

(21) Appl. No.: 16/853,734

(22) Filed: Apr. 20, 2020

(65) Prior Publication Data

US 2020/0378635 A1 Dec. 3, 2020

Related U.S. Application Data

(63) Continuation-in-part of application No. 16/565,296, filed on Sep. 9, 2019, now Pat. No. 11,306,919, and a continuation-in-part of application No. 29/667,986, filed on Oct. 26, 2018, now Pat. No. Des. 882,055, and a continuation-in-part of application No. 16/146,387, filed on Sep. 28, 2018.

(60) Provisional application No. 62/728,808, filed on Sep. 9, 2018, provisional application No. 62/567,449, filed on Oct. 3, 2017.

(51) Int. Cl.

| | |
|---|---|
| ***F24F 6/12*** | (2006.01) |
| ***F24F 13/32*** | (2006.01) |
| *F24F 6/00* | (2006.01) |

(52) U.S. Cl.

CPC ..... *F24F 6/12* (2013.01); *F24F 13/32* (2013.01); *F24F 2006/008* (2013.01)

(58) Field of Classification Search

CPC ..... F24F 6/12; F24F 13/32; F24F 2006/008
USPC ..... 261/72.1; 392/405
See application file for complete search history.

(56) References Cited

U.S. PATENT DOCUMENTS

| | | | | | |
|---|---|---|---|---|---|
| 3,901,443 | A | | 8/1975 | Mitsui et al. | |
| 3,970,250 | A | | 7/1976 | Drews | |
| 3,990,427 | A | | 11/1976 | Clinebell | |
| 4,810,854 | A | | 3/1989 | Jursich et al. | |
| 5,111,529 | A | | 5/1992 | Glucksman | |
| 5,131,070 | A | | 7/1992 | Chiu et al. | |
| 5,354,515 | A | * | 10/1994 | Ushimaru | B01D 61/46 261/72.1 |
| 5,397,510 | A | * | 3/1995 | Clark | F24F 6/02 261/107 |
| 5,483,616 | A | * | 1/1996 | Chiu | F24F 6/043 261/107 |
| 5,485,828 | A | | 1/1996 | Hauser | |
| 5,529,726 | A | * | 6/1996 | Glenn | F24F 6/04 261/107 |
| 5,624,608 | A | | 4/1997 | Ching et al. | |

(Continued)

*Primary Examiner* — Charles S Bushey
(74) *Attorney, Agent, or Firm* — Avyno Law P.C.

(57) ABSTRACT

The present invention provides an improved humidifier, having a novel tank design. The humidifier includes a misting assembly, a water tank and a base supporting the misting assembly and the water tank. The water tank and misting assembly are mated together immediately adjacent to one another on top of the base to form a column on the base. The water tank is removable from the base and includes a cap with a valve gasket at its bottom. The valve gasket of the water tank is opened upon placing the water tank on the base. The base further includes a recessed portion for receiving the water from the water tank and feeding the water to direct to the misting assembly.

7 Claims, 7 Drawing Sheets

(56) References Cited

U.S. PATENT DOCUMENTS

| | | | | |
|---|---|---|---|---|
| 5,783,117 | A * | 7/1998 | Byassee | F24F 6/043 261/107 |
| 6,053,482 | A * | 4/2000 | Glenn | F24F 6/043 261/104 |
| 6,135,427 | A | 10/2000 | Tsai | |
| 6,226,451 | B1 | 5/2001 | Wong | |
| 6,244,576 | B1 | 6/2001 | Tsai | |
| 6,314,237 | B1 | 11/2001 | Glucksman | |
| 6,477,322 | B1 | 11/2002 | Crowhurst | |
| 6,511,050 | B2 | 1/2003 | Chu | |
| 6,591,061 | B2 * | 7/2003 | Wang | F24F 6/10 392/395 |
| 6,604,733 | B2 * | 8/2003 | Mulvaney | F24F 6/043 261/DIG. 65 |
| 6,715,739 | B2 * | 4/2004 | Mulvaney | F24F 6/043 261/107 |
| 7,350,773 | B2 | 4/2008 | French et al. | |
| 7,377,493 | B2 | 5/2008 | Thomas | |
| 7,810,742 | B2 | 10/2010 | Levi | |
| 9,440,240 | B2 * | 9/2016 | Mills | B03C 3/32 |
| 10,436,466 | B2 * | 10/2019 | Kim | F24F 6/02 |
| 2003/0051886 | A1 | 3/2003 | Adiga et al. | |
| 2003/0206731 | A1 | 11/2003 | Glucksman | |
| 2004/0084787 | A1 * | 5/2004 | Williams | F24F 6/00 261/72.1 |
| 2005/0169615 | A1 * | 8/2005 | Glucksman | F24F 6/025 392/405 |
| 2006/0115388 | A1 | 6/2006 | Sanderson | |
| 2011/0250978 | A1 * | 10/2011 | O'Neill | F24C 7/004 472/65 |
| 2016/0082220 | A1 | 3/2016 | Barker et al. | |
| 2017/0197056 | A1 | 7/2017 | Schalkwyk et al. | |
| 2017/0197057 | A1 | 7/2017 | Osborne et al. | |
| 2018/0361106 | A1 | 12/2018 | Kuriger et al. | |
| 2019/0101301 | A1 | 4/2019 | Ediger et al. | |

* cited by examiner

PORTABLE HUMIDIFIER

RELATED APPLICATIONS

This application is a continuation-in-part of U.S. Design Patent Application Ser. No. 29/667,986, filed on Oct. 26, 2018, titled Humidifier, which is now issued as U.S. Patent No. D882,055; this application is also a continuation-in-part of U.S. patent application Ser. No. 16/565,296, filed Sep. 9, 2019, titled Portable Steam Humidifier which is now issued as U.S. Pat. No. 11,306,929; which application claims priority to U.S. Provisional Patent Application Ser. No. 62/728,808, filed Sep. 9, 2018, titled Portable Steam Humidifier; and this application is also a continuation-in-part of US. patent application Ser. No. 16/146,387, filed Sep. 28, 2018, titled Portable Steam Humidifier, which application claims priority to U.S. Provisional Patent Application Ser. No. 62/567,449, filed Oct. 3, 2017, titled Portable Steam Humidifier, all of the above application which are incorporated into this application in their entirety by reference in this application.

FIELD OF THE INVENTION

The present invention is related in general to an improved humidifier design, and in particular, to an improved water tank for use with a portable humidifier.

BACKGROUND OF THE INVENTION

A humidifier is a device that increases humidity (moisture) in a given space by circulating air with high moisture content. In the home, point-of-use humidifiers are commonly used to humidify a single room, while whole-house or furnace humidifiers, which connect to a home's HVAC system, provide humidity to the entire house. A "portable" humidifier may range in size from a small tabletop appliance to a large floor-mounted unit. The water is usually supplied by manually filling the unit on a periodic basis.

A common problem with humidifiers is that the water tanks are difficult to fill, hard to install, hard to clean and hard to carry. Further, often times, it is difficult to view the water in the tank to determine the water level. Finally, it can be difficult to configure the water tank with the misting assembly together to create a compact portable humidifier.

Accordingly, an improved humidifier design is needed that overcomes the limitations of the prior art. In particular, a clean, efficient, safe and quiet humidifier is desired. Further, a humidifier is desired that has a tank that is easy to fill, install, clean and carry, and that can mate with the misting assembly in a manner to create a compact humidifier. It is further desired that the water level can be easily viewed in the tank from all angles.

SUMMARY

The present invention relates to an improved humidifier design. The humidifier of the present invention includes a base for receiving a water tank. The base further supports a misting assembly thereon. The water tank includes a reservoir having a top and a bottom, where the reservoir has a handle at its top and a base plate having a central opening at its bottom. The base plate and reservoir mate with at least a portion of the perimeter of base of the humidifier. The water tank further includes a cap mounted on the central opening of the base plate. The cap has a hole with a spring loaded plunger positioned through the hole with a valve gasket at its top for closing and opening the hole of the cap. The base of the humidifier includes a recessed portion for receiving the cap. Within the recessed portion is a peg for aligning with the spring loaded plunger in the cap when the water tank is positioned on the base of the humidifier, such that when the water tank is positioned on the base, the valve gasket is opened and water is released into the recessed portion of the base such that the water can flow from the water tank to the misting assembly.

A water tank for a humidifier is further provided, where the humidifier includes a base for receiving the water tank. The water tank includes a reservoir having a top and a bottom. The reservoir further includes a handle at its top and a base plate having a central opening at its bottom, the base plate and reservoir having a same perimeter shape as a portion of base for receiving the water tank. The water tank further includes a cap mounted on the central opening of the base plate having a spring loaded plunger and valve gasket through a central opening in the cap for release water from the reservoir. The water tank and misting assembly mate atop the base such that the water tank and misting assembly together fill the perimeter of the base, creating a tower assembly. Further, the water tank and misting assembly may be mounted immediately adjacent one another at top the base such the water can flow from the underneath the tank to the misting assembly. In one example of an implementation, directly underneath the misting assembly, or included as part of the misting assembly, is an ultrasonic disk for creating a mist for emission by the misting assembly.

In yet another example, the humidifier includes a misting assembly, a water tank and a base supporting the misting assembly and the water tank. The water tank and misting assembly are mated together immediately adjacent to one another on top of the base to form a column on the base. The water tank is removable from the base and includes a cap with a valve gasket at its bottom. The valve gasket of the water tank is opened upon placing the water tank on the base. The base further includes a recessed portion for receiving the water from the water tank and feeding the water directly to the misting assembly. Both the water tank and misting assembly are positioned on top of the recessed portion of the base. The misting assembly may include an ultrasonic disk positioned under the misting spout for contacting the water in the recessed portion of the base (released from the tank) and creating a mist for passing the water through the misting assembly.

Other devices, apparatus, systems, methods, features and advantages of the invention are or will become apparent to one with skill in the art upon examination of the following figures and detailed description. It is intended that all such additional systems, methods, features and advantages be included within this description, be within the scope of the invention, and be protected by the accompanying claims.

DESCRIPTION OF FIGURES

The invention may be better understood by referring to the following figures. The components in the figures are not necessarily to scale, emphasis instead being placed upon illustrating the principles of the invention.

DETAILED DESCRIPTION

As illustrated in FIGS. 1-9, the present invention relates to a humidifier 100, and more particularly, to an improved humidifier 100 having a water tank 102 that is easy to fill, install, clean and carry. The improved humidifier 100 is further designed such that the water level in the water tank 102 can be easily viewed in the tank 102 from all angles and where the humidifier tank mates with an adjacent misting assembly 106 to provide a compact portable humidifier. The humidifier 100 illustrated in FIGS. 1-9 is a cool mist, ultrasonic humidifier; however, those skilled in the art will recognize that the present invention may be used in other types of humidifiers without departing from the scope of the invention.

Figure 1:
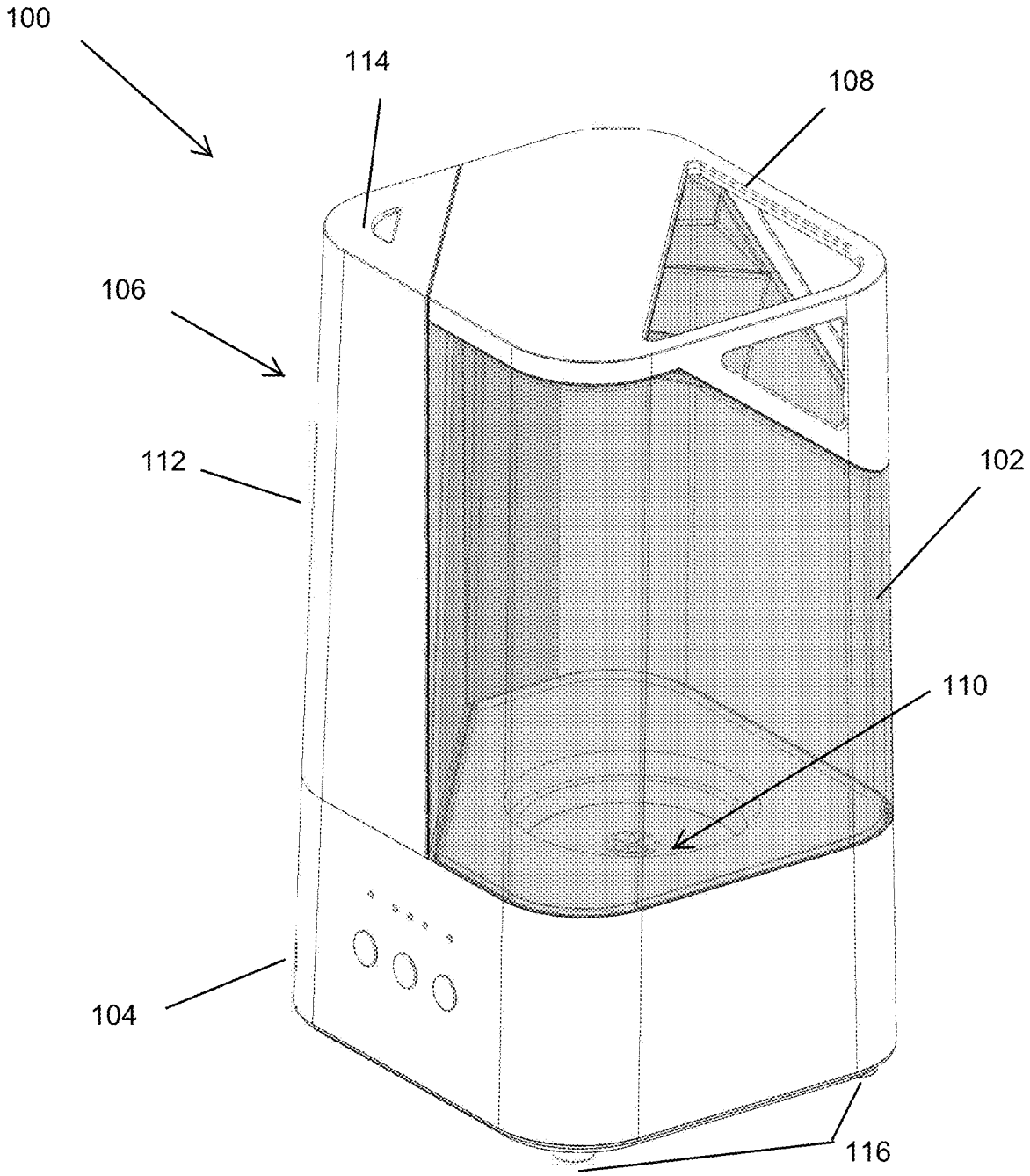
FIG. 1 is a front perspective view of one example of an implementation of the humidifier of the present invention.

FIG. 1 illustrates a front perspective view of one example of an implementation of a humidifier 100 of the present invention. As shown in FIG. 1, the humidifier 100 includes a base 104, having a tank 102 and a misting assembly 106 attached to the base 104. As shown, the misting assembly 106 includes a misting spout 112 and misting nozzle 114. The tank 102 is seated on top of the base 104, and further includes a top 108. A cap 110 is located on the bottom of the tank 102, supporting the tank 102 on the base 104. The base 104 of the humidifier 100 may include attached feet 116. The tank 102 is removable and refillable.

Figure 2:
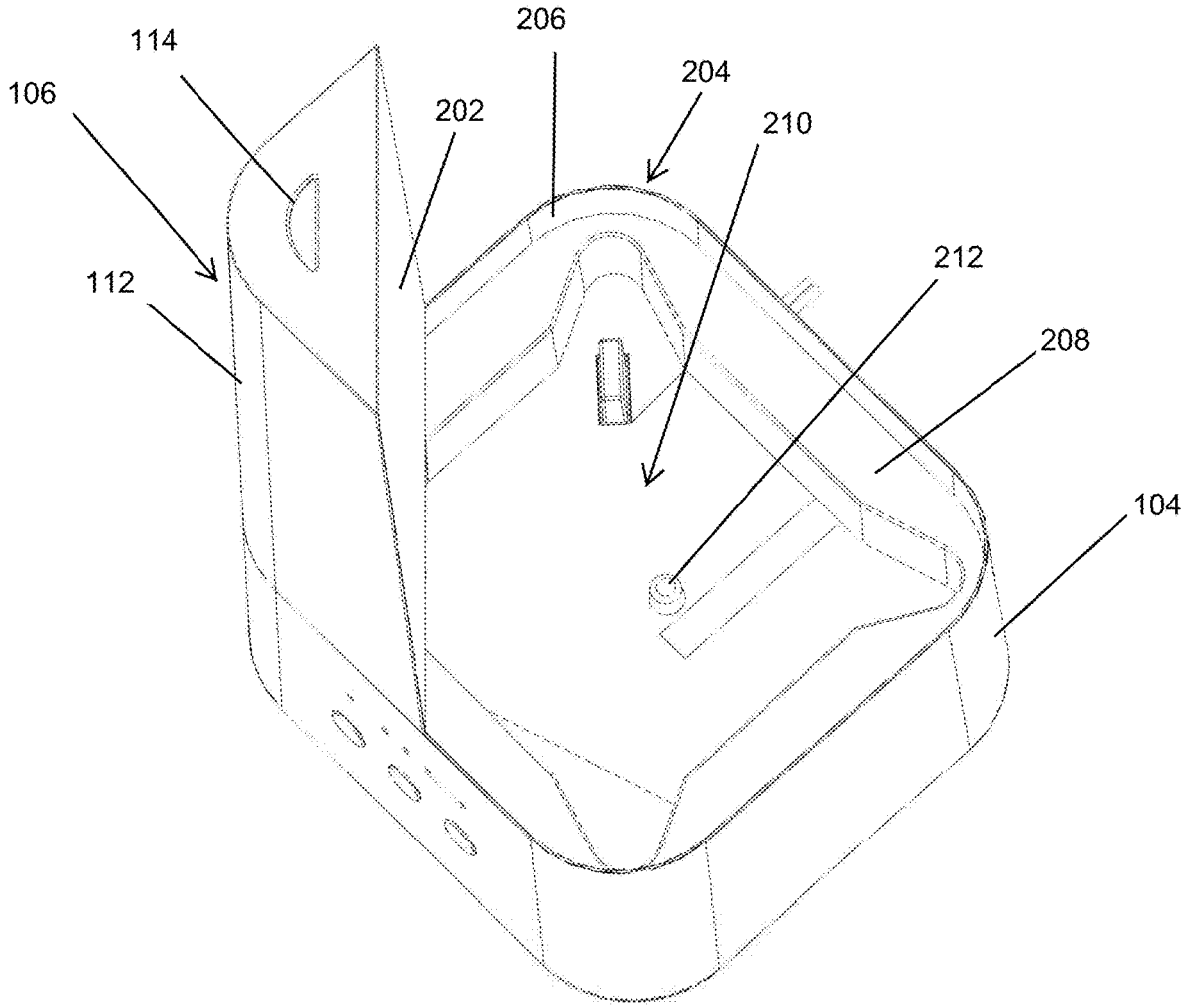
FIG. 2 is a top perspective of the humidifier of the present invention of FIG. 1 with the tank removed.

FIG. 2 is a top perspective of the humidifier 100 of the present invention of FIG. 1 with the tank 102 removed. As illustrated, the misting assembly 106 is positioned on one corner of the base 104. The misting assembly 106 includes a misting spout 112 that extends upward from the base 104, terminating evenly with the top of the tank 102 when the tank 102 is inserted in the base 104. At its top, the misting assembly 106 includes a misting nozzle for releasing vapor. The misting assembly 106 further includes a flat interior side surface 202 for mating with a flat side surface 408 (FIG. 4) of the tank 102. The tank receiving portion 204 of the base 104 includes perimeter walls 206. A perimeter platform 208 is positioned within the perimeter walls 206 of the base 106 and a recessed portion 210. The recessed portion 210 feeds water to an ultrasonic disk (not shown) located under the misting assembly 106 that shatters water into a fine mist for disbursement into the environment through the misting assembly 106. Within the recessed portion 210 is a peg 212 for engaging a plunger 502 (FIG. 5) on the tank 204 for releasing the water in the tank 102 into the recessed portion 210.

Figure 3:
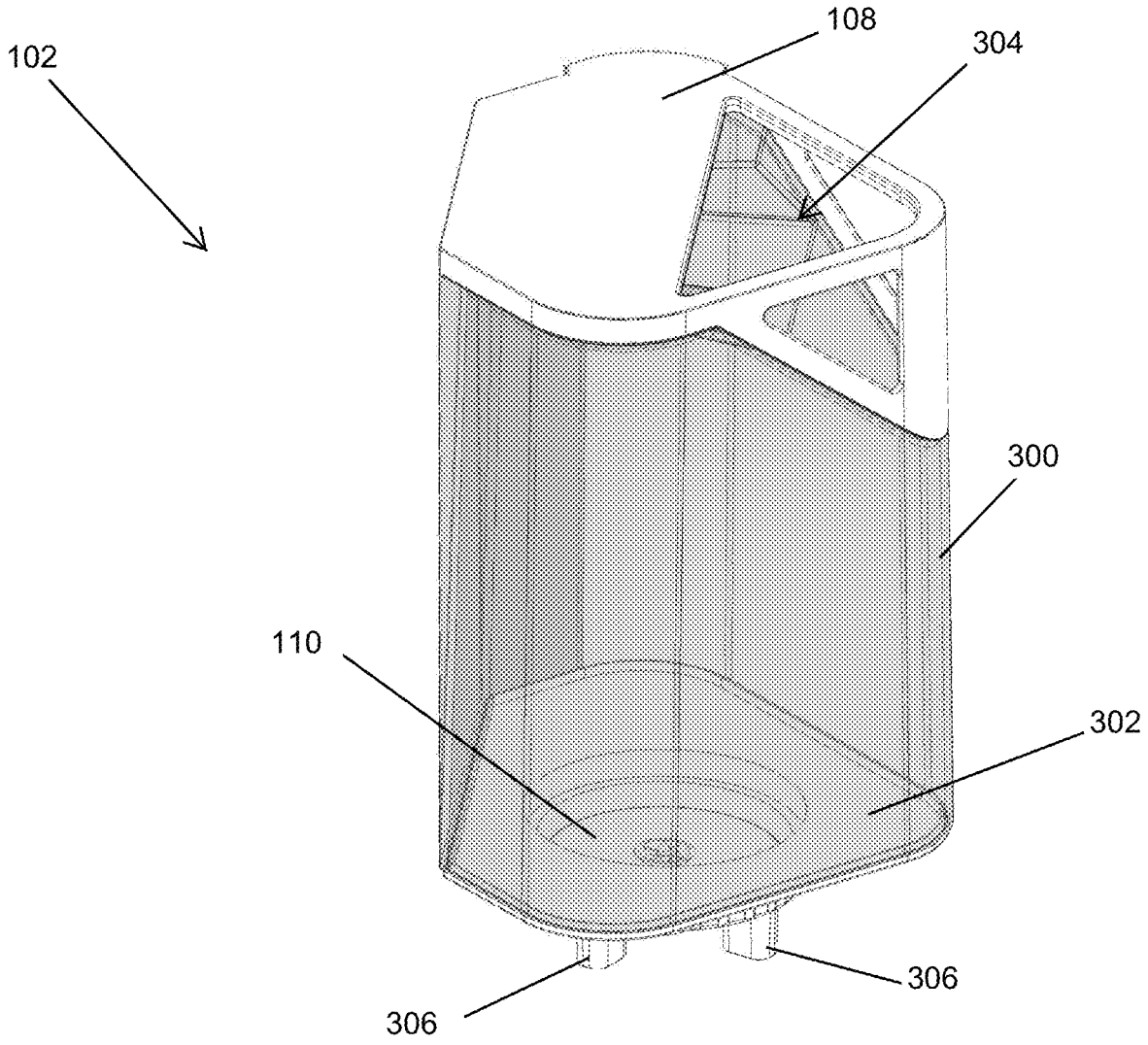
FIG. 3 is a front perspective view of the tank of FIG. 1 removed from the base of the humidifier.

FIG. 3 is a front perspective view of the tank 102 of FIG. 1 removed from the base 104 of the humidifier 100. As shown, the tank 102 includes a reservoir 300, a top 108 having a handle 304, a bottom plate 302 and a cap 110. The reservoir 300 is open at the bottom and is shaped to fit within the perimeter walls 206 of the base 104. The reservoir 300 is closed at its bottom by a flat, bottom plate 302 that rests on the platform 208 of the base. As will be described in more detail below, the bottom plate 302 has includes a cap 110 that is removable secured to the bottom plate 302 for filling the reservoir 300 of the tank 102 with water. The cap 110 includes supports 306 for supporting the tank 102 within the recessed portion 210 of the base 104.

Figure 4:
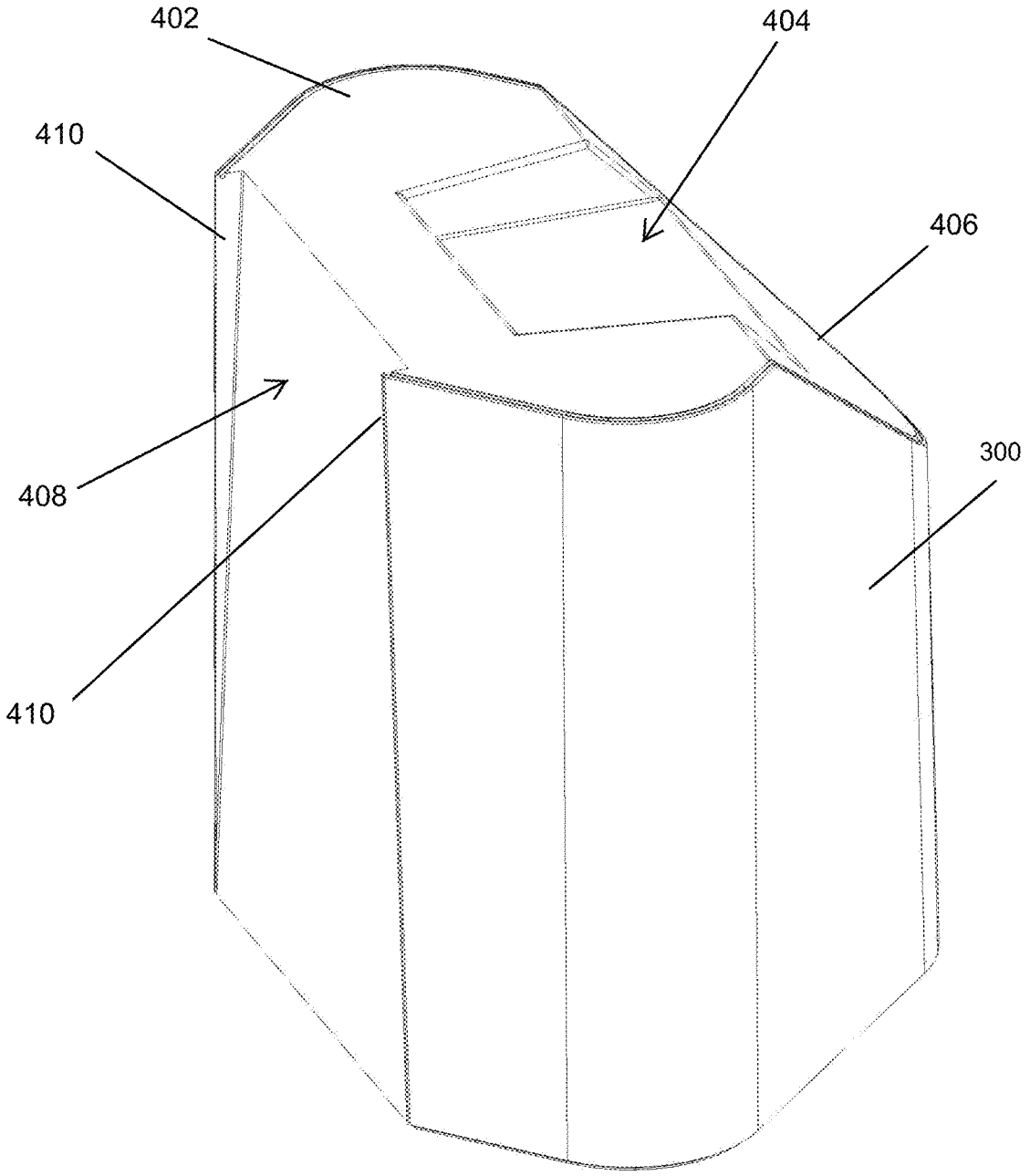
FIG. 4 is a side perspective view of the reservoir of the tank of FIG. 3.

FIG. 4 is a side perspective view of the reservoir 300 of the tank of FIG. 3 with the top 108, bottom plate 302 and cap 110 removed from the tank 102. As illustrated, the reservoir 300 includes a generally flat upper surface 402 for receiving the top 108. At its upper surface 402, the reservoir 300 further includes a shelf 404 and angled surface 406 for creating space under openings in the top 108 to form a handle 304 so that the top 108 can remain flat, yet still function to allow a user to grab the top 108 and remove it from the base 104.

As shown in FIG. 4, the reservoir 300 further includes a flat side surface 408 having guide rails 410 for mating with the misting assembly 106 and guiding the tank 102 to the base 104 along the flat interior side surface 202 of the misting assembly 106.

Figure 5:
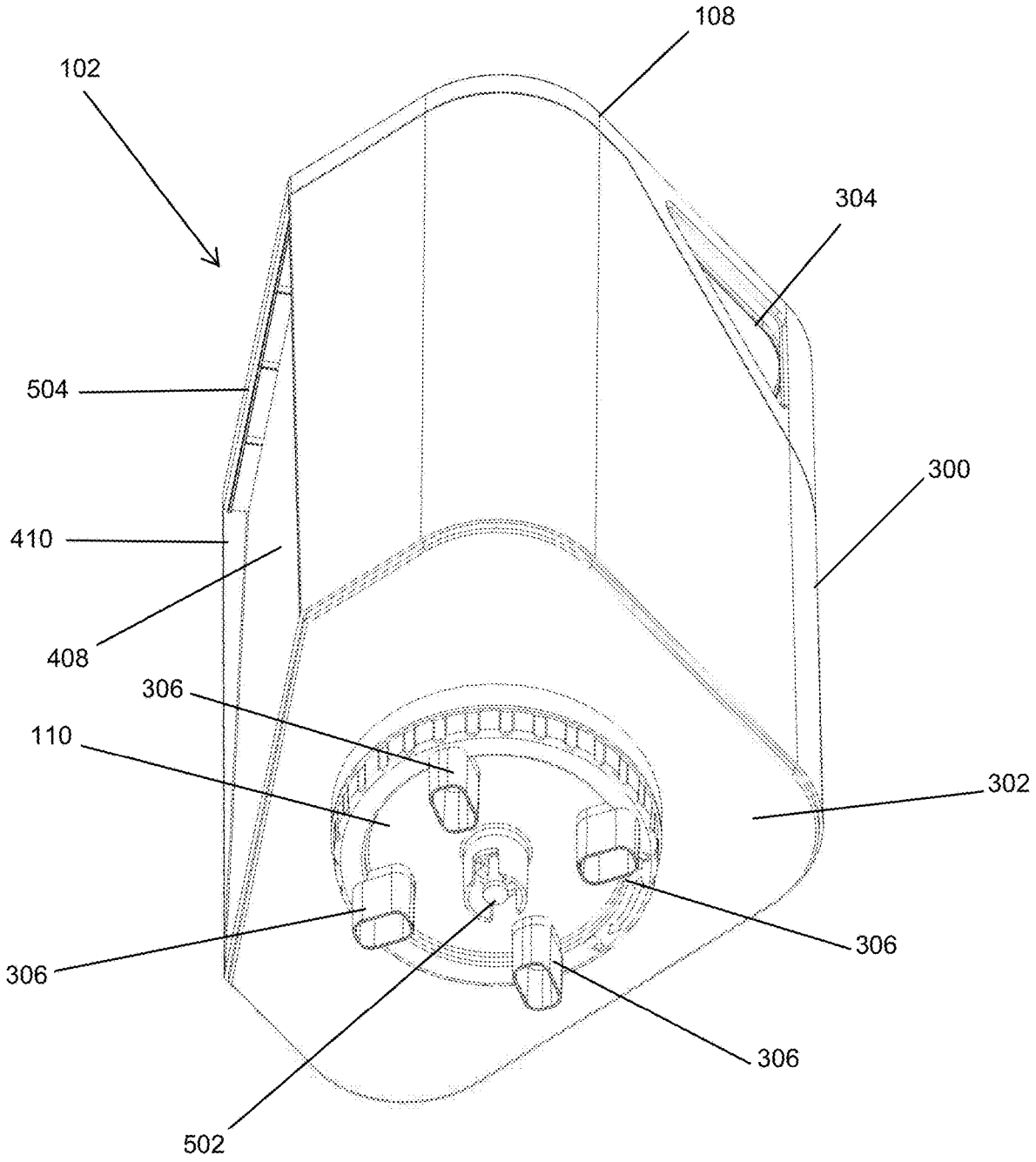
FIG. 5 is a bottom perspective view of the tank of FIG. 1 removed from the base of the humidifier.

FIG. 5 is a bottom perspective view of the tank of FIG. 1 removed from the base 104 of the humidifier 100. As illustrated, the cap 110 includes a hole at its center, with a spring loaded plunger 502 positioned through the hole. A valve gasket 804 (FIG. 8) is attached to the plunger 502. Together the valve gasket 804 and plunger 502 keep the hole in the cap 110 closed until the plunger is depressed. In operation, the tank 102 of is filled with water and then placed onto the base 104 so that the plunger 28 is depressed by the peg 212 on the base 106, thus opening the valve gasket 804 and allowing water to enter the recessed portion 210 of the base 104. The supports 306 contact the recessed portion 210 of the base 104, keeping the cap 110 elevated above the base. Simultaneously, the bottom plate 302 is able to contact the platform 208 on the base 104 to encapsulate the recessed portion 210 under the tank 102.

FIG. 5 also illustrates that the flat side surface 408, located within the guide rails 410 that engage the misting assembly 106, is inclined inward as it approaches the upper portion of the reservoir 300. This allows the top cap 108 to create an overhang 504 to rest on the flat angled portion of the misting assembly 106 that allows the tank 102 to mount on the misting assembly 106 in a sliding manner.

Figure 6:
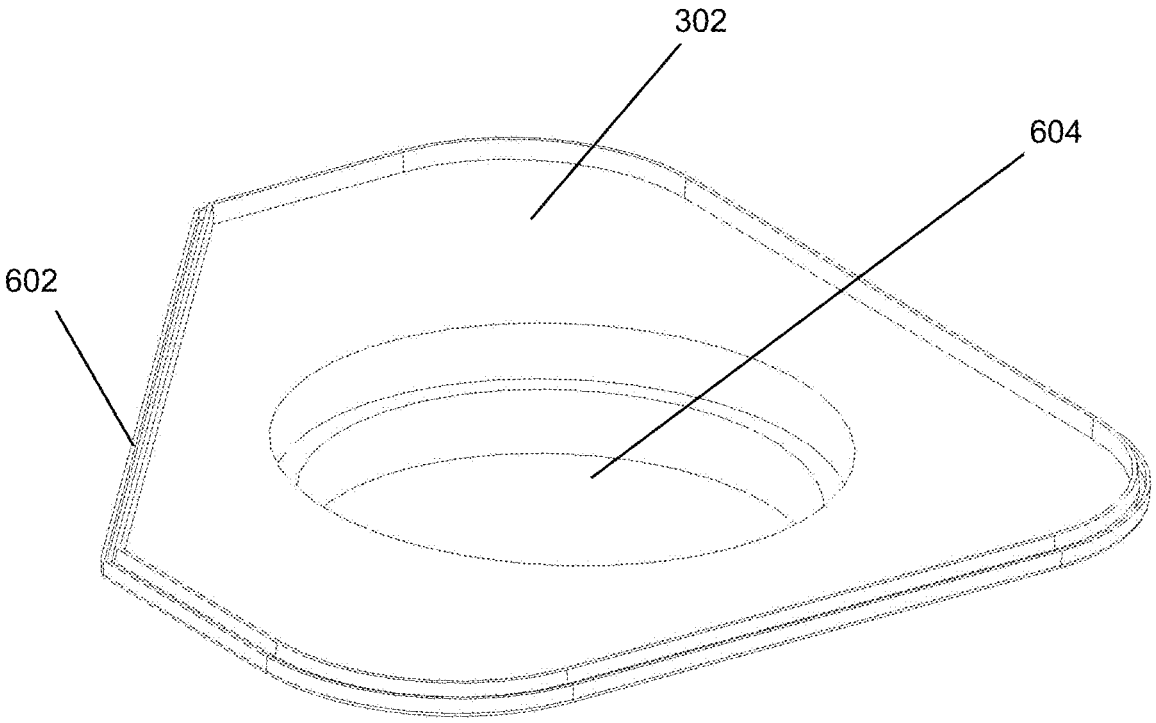
FIG. 6 is a top perspective view of the bottom plate of the tank of FIG. 5.

FIG. 6 is a top perspective view of the bottom plate 302 of the tank of FIG. 5. As shown in FIG. 6, the bottom plate 302 includes an opening 604 for receiving the cap 100.

The bottom plate 302 also includes a perimeter groove for receiving and securing the bottom edge of the reservoir 300 of the tank 102.

Figure 7:
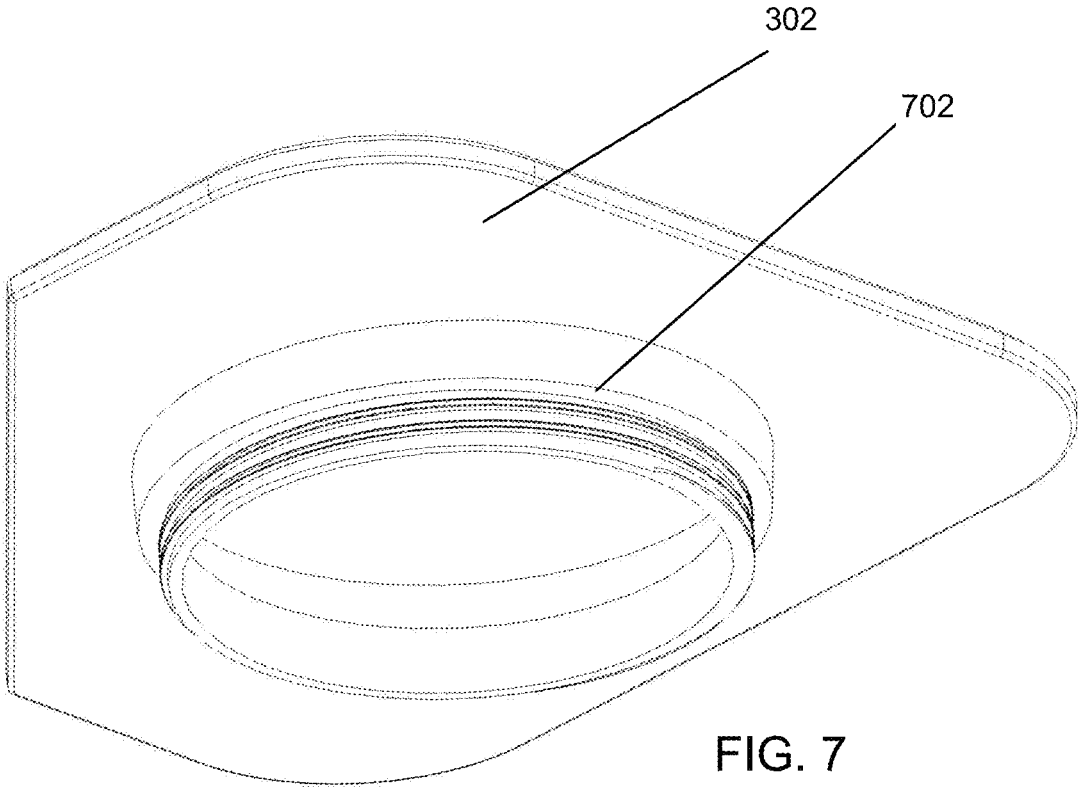
FIG. 7 is a bottom perspective view of the bottom plate of the tank of FIG. 6.

FIG. 7 is a bottom perspective view of the bottom plate 302 of the tank 102 of FIG. 6. In this view, it can been seen that the opening 604 includes exterior threading 702 for engaging the cap FIG. 8.

Figure 8:
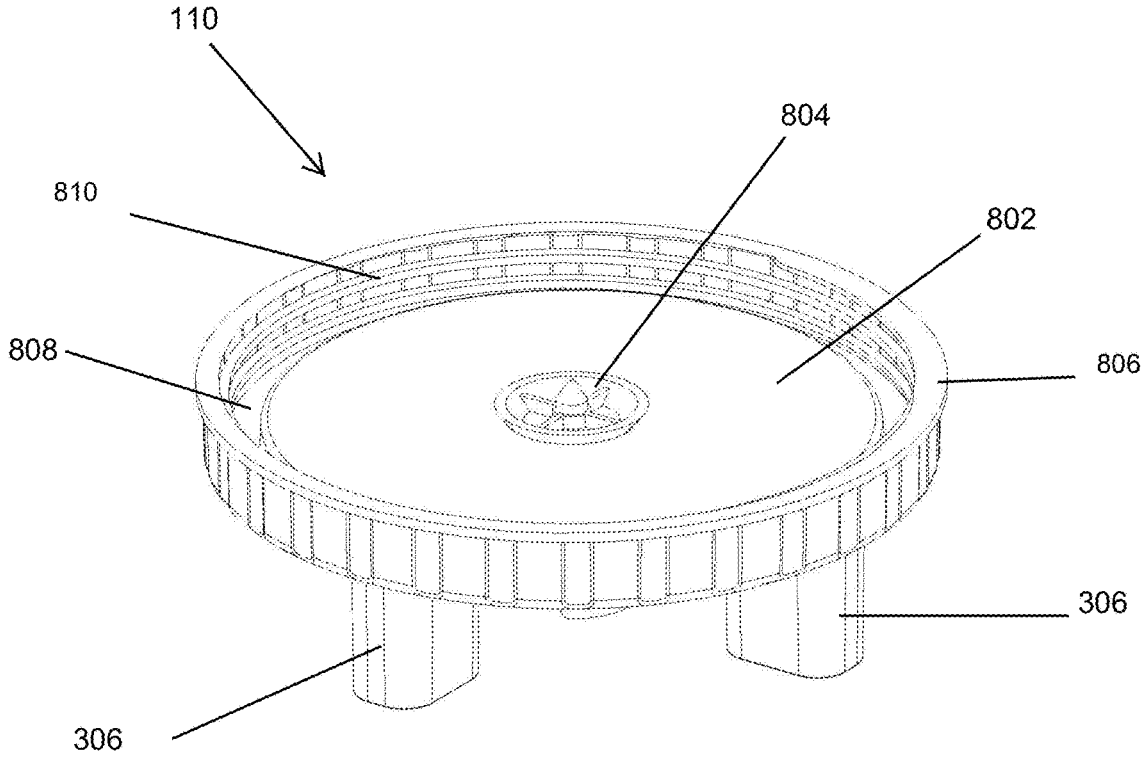
FIG. 8 is a top perspective view of the cap of the tank of FIG. 5.

FIG. 8 is a top perspective view of the cap 110 of the tank 102 of FIG. 5. As described previously, the cap 110 includes a center disk 802 having a hole at its center. A valve gasket 804 is attached to a plunger 502, which, as can be best seen in this illustration, covers the hole in the center disk 802. When closed, the valve gasket 804 keeps the water in the reservoir 300 of the tank.

The cap 110 further includes perimeter walls 806 having interior threading 810 for mating with the exterior threading 702 on the bottom plate 302. Between the center disk 802 and perimeter wall 806 is a o-ring for creating a water proof sealing between the cap 110 and the base plate 302.

Figure 9:
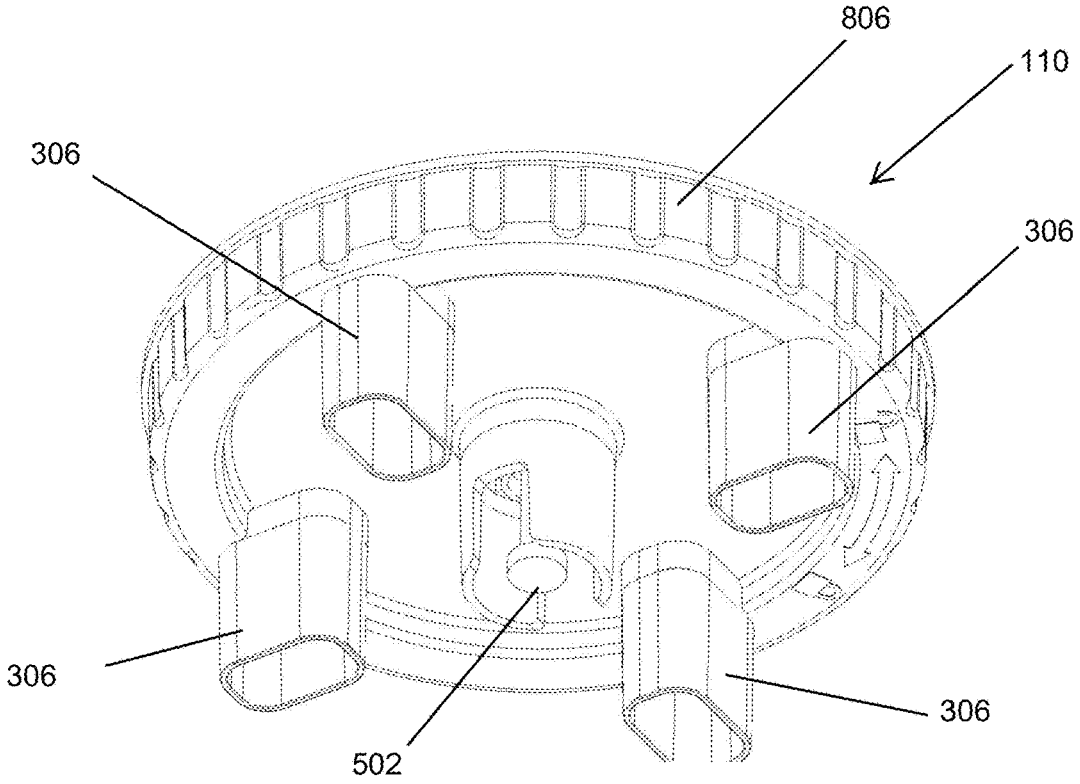
FIG. 9 is a bottom perspective view of the cap of the tank of FIG. 8.

FIG. 9 is a bottom perspective view of the cap 110 of the tank 102 of FIG. 8. Together the valve gasket 804 and plunger 502 keep the hole in the cap 110 closed until the plunger 502 is depressed. In operation, the tank 102 of is filled with water and then placed onto the base 104 so that the plunger 502 is depressed by the peg 212 on the base 104, thus opening the valve gasket 804 and allowing water to enter the recessed portion 210 of the base 104. The supports 306 contact the recessed portion 210 of the base 104, keeping the cap 110 elevated above the base. Simultaneously, the bottom plate 302 is able to contact the platform 208 on the base 104 to encapsulate the recessed portion 210 under the tank 102.

As illustrated in the figures, the tank 102 has flat top 108 so that when the tank 102 is removed for refilling, the tank 102 can be turned upside and supported on a flat surface by the top 108, allowing for refilling without the requirement of holding the tank 102 continuously during refilling. Further, the cap 110 is large enough to allow for one to easily clean the inside of the tank 102. The recessed portion 210 of the base 104, which transfer the water from the reservoir 300 to the ultrasonic disk under the misting assembly 106 is further easily assessable for cleaning by removing the bse tank 102. The ultrasonic disk is also accessible from the recesses for cleaning, making the humidifier design of the present invention highly desirable.

Further, with the current design of the humidifier 100 being generally square or rectangular in construction and having the misting assembly 106 mating with the tank 102 at one corner of the tank 102, when the tank is transparent, the level in the tank 102 can be seen from all orientations of the humidifier.

In operation, the tank 102 is filled with water and then place onto the base 104 so that the plunger 502 of the tank 102 is depressed, opening the valve gasket 504. The opening of valve gasket 504 allows water to enter the recessed portion of the base 104 and flow to the ultrasonic disk under the misting assembly for creating mist, which is then emitted from the misting spout 112 at the top of the misting nozzle 114. The electronics (not shown) for operating the ultrasonic disk are positioned under the recessed portion 210 within the base 104. As water is consumed, the water level will lower thus allowing air into the tank 102 until the water level has been lowered to a point where the air can escape from the tank 102.

The foregoing description of an implementation has been presented for purposes of illustration and description. It is not exhaustive and does not limit the claimed inventions to the precise form disclosed. Modifications and variations are possible in light of the above description or may be acquired from practicing the invention. It will be readily appreciated that many deviations may be made from the specific embodiments disclosed in this specification without departing from the spirit and scope of the invention. It is intended that the scope of the present invention not be limited by this detailed description, but by the claims and the equivalents to the claims appended hereto.

What is claimed is:

1. A water tank for a humidifier where the humidifier includes a base for receiving the water tank, the water tank comprising:

a reservoir having a top and a bottom, where the reservoir has a handle at its top and a base plate having a central opening at its bottom, where the central opening covers a substantial area of the base plate, the base plate and reservoir having a same perimeter shape as at least part of the base of the humidifier; and a cap mounted on the central opening of the base plate, the cap having a center disk with a hole at its center and perimeter walls surrounding the center disk, the cap further including a spring loaded plunger and valve gasket for opening and closing the hole on the center disk of the cap and at least one support member for supporting the water tank and keeping the cap elevated above the base, where the at least one support member has a perimeter wall extending at least partially from the center disk between the perimeter walls surrounding the center disk and the spring loaded plunger, and where the perimeter wall of the at least one support member encloses an open center.

2. A humidifier, the humidifier comprising:

a base for receiving a water tank, having a recessed portion that includes a central peg;

a misting assembly supported on the base;

the water tank having a reservoir having a top and a bottom, where the reservoir has a handle at its top and a base plate having a central opening at its bottom, where the central opening covers a substantial area of the base plate, the base plate and reservoir matching at least a portion of the perimeter shape of base of the humidifier; and a cap mounted on the central opening of the base plate, the cap having a center disk with a hole at its center and perimeter walls surrounding the center disk, the cap further including a spring loaded plunger and valve gasket for closing the opening in the hole of the center disk and aligning with the central peg in the base when the water tank is positioned in the base of the humidifier and at least four support members for supporting the water tank and keeping the cap elevated above the base, where each of the at least four support members has a perimeter wall extending at least partially from the center disk between the perimeter walls surrounding the center disk and the spring loaded plunger and valve gasket, where the perimeter wall in each of the at least four support members encloses an open center, and where when the water tank is positioned on the base, the valve gasket is opened and water is released into the recessed portion of the base such that the water can flow from the tank through to the misting assembly.

3. A humidifier, the humidifier comprising:

a misting assembly;

a water tank, the water tank having a reservoir having a top and a bottom, where the reservoir has a handle at its top and a base plate having a central opening at its bottom, where the central opening is positioned at the geometric center of the base plate and covers a substantial area of the base plate;

a base supporting the misting assembly and the water tank, mated together immediately adjacent to one another on top of the base to form a column on the base;

where the water tank is removable from the base and includes a cap at the bottom having a center disk with a perimeter edge and a valve gasket positioned at the center of the cap, where the valve gasket of the water tank is opened upon placing the water tank on the base, and where the cap includes at least one support member for supporting the water tank and keeping the cap elevated above the base, where the at least one support member has a perimeter wall extending at least partially from the center disk of the cap between the perimeter edge of the center disk and valve gasket, where the perimeter wall of the at least one support member encloses an open center; and where the base includes a recessed portion for receiving the water from the water tank and feeding the water to the misting assembly.

4. The humidifier of claim 3 where both the water tank and misting assembly are positioned on top of the recessed portion of the base.

5. The humidifier of claim 1 where the cap screws onto the central opening of the base plate.

6. The humidifier of claim 1 where the cap includes four support members.

7. The humidifier of claim 1 where the at least one support member extends further away from the center disk than the spring loaded plunger.

* * * * *